US006491727B1

(12) United States Patent
Rearick et al.

(10) Patent No.: US 6,491,727 B1
(45) Date of Patent: Dec. 10, 2002

(54) METHODS FOR REDUCING THE FLAMMABILITY OF CELLULOSIC SUBSTRATES

(75) Inventors: William A. Rearick, Cary, NC (US); John Turner, Inman, SC (US); Michele Lefeber Wallace, Cary, NC (US); Dana Wernsman, Pikeville, NC (US)

(73) Assignee: Cotton Incorporated, New York, NY (US)

( * ) Notice: Subject to any disclaimer, the term of this patent is extended or adjusted under 35 U.S.C. 154(b) by 0 days.

(21) Appl. No.: 09/329,168

(22) Filed: Jun. 9, 1999

(51) Int. Cl.[7] ..... D06M 11/00; D06M 23/00; D06M 13/00

(52) U.S. Cl. ..... 8/116.1; 8/116.1; 8/116.4; 8/120; 8/129; 8/184; 8/185; 8/127.1

(58) Field of Search ..... 8/116.1, 120, 127.1, 8/116.4, 129, 184, 189

(56) References Cited

U.S. PATENT DOCUMENTS

| | | | | | |
|---|---|---|---|---|---|
| 2,998,329 | A | | 8/1961 | Sovish et al. | 117/93 |
| 3,325,385 | A | | 6/1967 | Keene et al. | 204/159.12 |
| 3,526,048 | A | | 9/1970 | Rowland et al. | 38/144 |
| 3,669,916 | A | | 6/1972 | Nakao et al.. | 260/17.4 |
| 3,677,692 | A | | 7/1972 | Arthur et al. | 8/120 |
| 3,709,658 | A | | 1/1973 | Walsh et al. | 8/129 |
| 3,746,572 | A | | 7/1973 | Weil et al. | |
| 3,899,289 | A | | 8/1975 | Berni et al. | 8/120 |
| 3,926,549 | A | | 12/1975 | Mares et al. | 8/116 |
| 3,926,550 | A | | 12/1975 | Harris et al. | 8/116 |
| 3,926,555 | A | | 12/1975 | Reine et al. | 8/18.9 |
| 3,979,533 | A | * | 9/1976 | Moreau et al. | 427/390 |
| 4,095,945 | A | | 6/1978 | Umetani et al. | 8/115.7 |
| 4,108,748 | A | | 8/1978 | Portnoy et al. | 204/159 |
| 4,600,606 | A | | 7/1986 | Meschutin | 427/389 |
| 4,820,307 | A | | 4/1989 | Welch et al. | 8/120 |
| 4,936,865 | A | | 6/1990 | Welch et al. | 8/120 |
| 4,975,209 | A | | 12/1990 | Welch et al. | 252/8.6 |
| 5,042,986 | A | | 8/1991 | Kitchens et al. | 8/120 |
| 5,162,394 | A | * | 11/1992 | Trocino et al. | 523/208 |
| 5,221,285 | A | | 6/1993 | Andrews et al. | 8/127.1 |
| 5,273,549 | A | | 12/1993 | Didier et al. | 8/127.1 |
| 5,695,528 | A | | 12/1997 | Komori et al. | 8/127.1 |
| 5,733,750 | A | * | 3/1998 | Lund et al. | 435/72 |
| 5,879,408 | A | * | 3/1999 | Kubo et al. | 8/120 |
| 6,309,565 | B1 | | 10/2001 | Stowell et al. | |

OTHER PUBLICATIONS

Weil, Edward D., et al., "Oligomeric Phosphorus Esters With Flame Retardant Utility", *J. of Fire Retardant Chemistry,,* v.9: 39–49 (Technomic Publishing Co., Inc.) .Feb. 1982.

Welch, et al., "Mixed Polycarboxylic Acids and Mixed Catalyst in Formaldehyde–Free Durable Press Finishing," *Text. Chem. and Col.*, vol. 29, No. 3, p. 22–27 (1997).

Lewis, D. M., et al., "The Use of a Crosslinking Agent to Achieve Covalent Fixation of Hydroxyethylsulphone Dyes on Cotton", *International Conference and Exhibition, Philadelphia Marriott, Philadelphia, Pa.*, p375–383, Sep. 22–25, 1998.

* cited by examiner

*Primary Examiner*—Gregory Delcotto
*Assistant Examiner*—Eisa Elhilo
(74) *Attorney, Agent, or Firm*—Burns, Doane, Swecker & Mathis, LLP

(57) ABSTRACT

Compositions and methods of rendering cellulosic materials flame resistant, and articles of manufacture including the materials, are disclosed. The compositions include one or more crosslinking agents, and, optionally, one or more phosphorus-based compounds. Dimethyloldihydroxyethylene urea, imidazole, imidazolidinones, dialdehydes, and dichlorotriazines are preferred crosslinking agents. The methods involve applying the composition to the material, and covalently linking the crosslinking agent to the material. An advantage of covalently linking the crosslinking agent to the cellulosic material is the lack of any potential toxicity associated with uncrosslinked fire retardants on the cellulosic material and the stability of the bonds between the material and the crosslinking agent to conventional steam cleaning and other carpet cleaning methods. In a preferred embodiment, the fire-retardant cotton-fiber composition is used to prepare cotton carpets, upholstery or raised surface apparel.

21 Claims, No Drawings

METHODS FOR REDUCING THE FLAMMABILITY OF CELLULOSIC SUBSTRATES

FIELD OF THE INVENTION

The present application relates to methods for reducing the flammability of cellulosic substrates, including cotton fiber carpets and raised surface apparel.

BACKGROUND OF THE INVENTION

Cotton, like most textile fibers, is combustible. Whenever cotton is in the presence of oxygen and the temperature is high enough to initiate combustion (360–420° C.), untreated cotton will either burn (flaming combustion) or smolder (smolder combustion). The degree of flammability depends on the fabric construction. Fabrics have different flammability requirements depending on the particular end use. Cotton fabrics, without the use of special flame-retardant finishes, meet practically all of these requirements for most existing end-uses. However, some new cotton product developments require special constructions or finishes to reduce their flammability. This is especially true in certain countries, such as the United States, which have strict regulations governing the flammability of these products.

Resistance to burning is one of the most useful properties that can be imparted to cotton fibers and textiles. Some end uses for cotton in textiles for apparel, home furnishings, and industry, can depend on its ability to be treated with chemical agents (flame-retardants) that confer flame resistance (FR). End uses requiring flame-retardant finishes include protective clothing (e.g., foundry workers apparel and fire fighters uniforms), children's sleepwear, furnishing/upholstery, bedding, carpets, curtains/drapes, and tents.

Chemical agents for reducing the flammability of products containing cotton fiber and other cellulosic fibers are well known and generally grouped into two categories: durable and non-durable. The durable type tend not to be removed in conventional washes and the non-durable type are typically removed in conventional washes.

The variable manufacturing cost of a typical durable flame-retardant treatment is about $1–2 per yard, depending on fabric weight and other factors. This can be a major limitation. The flammability and flame resistance of cotton has been studied extensively and several comprehensive reviews of the subject are available.

Cotton is not currently the raw material of choice in the carpet industry. The carpet fiber business in the U.S. is roughly a 7,000,000 bale/year market, and cotton is less than one percent of this overall market. One reason that cotton has been almost excluded from this large market for fibers is the difficulty in complying with the Flammable Fabrics Act. This regulation requires that all carpets which are six feet by four feet or larger and are sold for residential use pass a flammability test. This test is commonly referred to as the "Pill Test". It calls for igniting a methenamine pill, which is placed in the center of a nine-inch by nine-inch carpet specimen. The specimen fails if the flame spreads to within one inch of a metal template containing an eight-inch diameter hole, which is placed on top of the carpet specimen prior to igniting the pill. The specimen passes if the flame does not spread to within one inch of the metal template.

For a residential carpet to be saleable, at least seven out of eight specimens must pass the test. Furthermore, if the carpet has been treated with a flame-retardant (with the exception of alumina trihydrate added to the back coating), then the carpet must be washed ten times as described in AATCC 124-1967 prior to testing.

There are numerous man-made fiber carpets which are currently available, many of which do not require any special treatments to pass federal flammability requirements because of the nature of the test. Many synthetic carpet fibers will melt away from the burning pill during the pill test, such that the pill eventually self extinguishes. The fuel load provided by these carpets in a fire, which is already burning, is not considered by the test method.

Other synthetic fiber carpets, such as polypropylene, require a flame-retardant such as alumina trihydrate. Alumina trihydrate is often added to a backcoating (or backing), as opposed to application directly to the carpet fibers. Synthetic thermoplastic fibers such as polypropylene melt quickly when exposed to a flame, for example, during the pill test. The burning pill then quickly falls, due to gravity, onto the backing. The backing typically includes three layers: a thermoplastic (usually polypropylene) primary backing layer, a latex adhesive layer (which may contain the flame-retardant) and a secondary thermoplastic (usually polypropylene) backing layer. Since the primary backing is also a low melting point thermoplastic, it quickly melts and allows the burning pill to come into direct contact with the latex. Since the latex often includes a flame-retardant, it can then suppress the spread of flames.

Certain other fibers, such as wool and modacrylic, are inherently flame resistant. These can be made into carpets which require no special treatments to pass the required pill test.

Cotton carpets can also be made which require no special treatments to pass the pill test. For example, a cut pile carpet can be made from a 3/2 Ne yarn composed of 90 percent cotton and 10 percent low melt thermoplastic fiber. The low melt fiber is allowed to melt, typically prior to tufting of the carpet. A carpet which includes 12 stitches per inch, 1/11-inch gauge, and ¼ inch pile height can be constructed from this yarn. Such a carpet is generally dense enough, with a sufficiently low pile height, that it will pass the pill test without any additional treatment.

A disadvantage of relying on such low pile height constructions when manufacturing cotton carpets is that it is very limiting from a design and marketing standpoint. The consumer in the U.S. today has become accustomed to a wide variety of choices when selecting a carpet. Substantially limiting the choices of carpet construction is not a practical option for a successful marketing program.

Another disadvantage of attempting to reduce the flammability of a cotton (or cellulosic) carpet by construction alone is that achieving reduced flammability often means increasing the area density (oz./square yard) of the carpet. As the area density of the carpet increases, the cost also generally increases. This approach is therefore very restrictive and would limit the market to the small, upper price end.

Alumina trihydrate, which is effective on certain thermoplastic fiber carpets, is not typically effective on cotton-containing carpets. On cotton-containing carpets, the cotton yarn which is under and in the vicinity of the burning pill will tend to char but maintain sufficient integrity to support, insulate and separate the burning pill from the carpet backing. There is not a sufficient heat flux reaching the alumina trihydrate contained in the latex backing for the alumina trihydrate to be effective at suppressing the flame.

The use of flame-retardant low melt fibers in place of the typical non-flame-retardant low melt fiber used in the yarn has been attempted. The low melt fiber, in general, offers the advantages of improved resilience and tuft definition and minimizes shedding of loose fibers from the tufts. Testing has shown that flame retardant low melt fiber used in the yarn is not effective. Although various explanations have been offered, the mechanism is not understood.

Since federal law in the U.S. requires that any carpet which has a flame-retardant treatment (other than alumina trihydrate) be laundered ten times prior to flammability testing, any such flame-retardant which is applied for that purpose must remain effective after the ten home launderings. Because home launderings are rather effective at removing materials which are not chemically bonded to the fibers, durable flame retardants are generally the most effective.

There have been many techniques for imparting durable flame resistance properties to cellulosic substrates described in the literature. However, there are relatively few that are practiced today, due to commercial availability of the chemicals, safety concerns, process control issues or other reasons. Durable flame retardants are typically more complex, more expensive and more difficult to apply than non-durable treatments. The main flame retardant finishes used on cotton are phosphorus-based.

Two of the more common phosphorus-based systems which are used to provide durable flame resistance to cotton substrates are the "pre-condensate"/ammonia process and the reactive phosphorus process.

In the "pre-condensate"/$NH_3$ process, the flame-retardant agent exists as a polymer in the fibrils of cotton fibers and is not combined chemically with OH groups in the cotton fiber. This process imparts durable flame resistance to 100% cotton fabrics when applied under proper application procedures. It produces fabrics with a good hand and strength retention. Proper application of pre-condensates to cotton fabrics requires adequate fabric preparation, proper padding/uniform application, proper phosphorus add-on relative to fabric properties, appropriate moisture control prior to ammoniation, control of the ammoniation step to ensure adequate polymer formation, and effective oxidation and washing of the treated fabric.

This process is very useful for specialty applications that can command a very high price, such as protective clothing for fire fighters and other workers who may be exposed to fire or excessive heat. It is generally not practical for cotton carpets or raised surface apparel that will be sold to the average consumer. The problems associated with this process include the high cost, the special equipment needed (ammoniation chamber) which is not generally available, and the two drying steps which are required.

Reactive phosphorus-based flame retardants are compounds (e.g., N-methylol dimethyl phosphonopropionamide (MDPPA)) that react with cellulose, the main constituent of cotton fiber. These compounds can be used both for cotton and for cotton blends with a low synthetic fiber content. The finish, usually applied to the fabric after the coloring stage, promotes char formation. The durability of the finish makes the resulting treated fabric suitable for curtains, upholstery, bed linen and protective clothing.

The reactive phosphorus-based flame retardants are typically applied using a pad/dry/cure method, in the presence of phosphoric acid catalyst. The finish is sometimes applied with a methylated melamine resin to increase the bonding/fixation of the agent to cellulose, which enhances the flame retardancy. Afterwashing is generally required, often with an alkali such as soda ash, followed by further rinsing and drying. The afterwashing helps to reduce loss of fabric strength. The reactive phosphorus-based process has the advantage of not requiring specialized equipment such as an ammonia cure unit, and has less affect on dyes than the pre-condensate process. However, this process can cause more strength loss than the pre-condensate process. Further, there can be a durability problem associated with some wash treatments if the instructions of the chemical supplier are not followed.

Reactive phosphorus-based flame retardants can be unsuitable for certain end uses, such as cotton or cotton blend carpets. This is especially true when the products contain formaldehyde, because of concerns about the human health effects of exposure to certain volatile organic compounds (VOC's) which may have been released from carpeting or carpet backing in past years. Because of this, most carpet manufacturers generally consider even very low levels of formaldehyde to be unacceptable. Another issue is that these products are generally designed to be afterwashed as part of the application procedure. While the toxicity of such materials is generally low, there are significant concerns about the exposure of babies or small children to residual unfixed chemicals left on the carpet.

A non-phosphorus approach for rendering cotton fire retardant has been to incorporate a water-insoluble, solid particulate mixture of brominated organic compounds and metal oxides, optionally with a metal hydrate, into the carpet fiber (U.S. Pat. No. 4,600,606 to Mischutin). However, a limitation of the chemistry is that the metal oxide compounds may be rendered soluble when washed if the pH of the solution is on the acid side. Also, particles of brominated organic compounds may be irritating to people coming into contact with them, and may be harmful if ingested.

Another non-phosphorus approach has been to prepare a solution of boric acid, ammonium sulfate, borax, hydrogen peroxide, and optionally a surfactant and/or an alkyl phthalate ester, and apply this as a coating on cellulosic materials. A major limitation of this chemistry is the water-solubility of the components, which results in the composition being substantially removed during conventional washing.

There is a need for fire retardants for cotton fiber, especially when the fiber is used in a cotton carpet or in raised surface apparel, that survives a certain number of washings, including steam cleanings. The present invention provides such materials.

SUMMARY OF THE INVENTION

Compositions and methods for providing cellulosic substrates with reduced flammability, and articles of manufacture prepared from the resulting fire-resistant cellulosic substrates, are disclosed.

The compositions include one or more crosslinking agents and optionally include one or more phosphorus-based compounds, such as phosphorus oligomers. The methods involve applying to a cellulosic substrate a composition including a crosslinking agent, optionally in the presence of a phosphorus-based compound, and covalently linking the hydroxy groups on the cellulosic substrate to one or more of the groups on the crosslinking agent.

Cotton is a preferred cellulosic substrate. Other cellulosic substrates include flax, jute, hemp, ramie, lyocell and regenerated unsubstituted wood celluloses such as rayon.

The crosslinking agents are reactive molecules which include two or more reactive groups, which are capable of reacting with the hydroxy groups on cotton, or with derivatives formed from the hydroxy groups on cotton, for example, mesylate, triflate, and tosylate leaving groups. Suitable groups on the crosslinking agent for reacting with hydroxy groups on a cellulosic substrate include typical leaving groups in nucleophilic displacement chemistry and similar displacement chemistries. Suitable groups on the crosslinking agent for reacting with derivatives of the hydroxy groups on a cellulosic substrate such as mesylates and triflates include typical nucleophiles in nucleophilic displacement chemistry and similar displacement chemistries. Examples of suitable crosslinking agents include dichlorotriazines, ureas, imidazolidinones, imidazoles, dialdehydes, urethanes, carbonates, orthocarbonates, chloroformate, dihalides such as 1,2-dichloroethane, diesters such as dimethylsuccinate, diacid halides such as succinyl chloride, and the like.

The phosphoric acids and other reactive phosphorus-containing functional groups on the phosphorus-based compounds and the hydroxy groups on the cellulosic substrate can be linked via the crosslinking agents.

The resulting cellulosic fiber is fire resistant. When the crosslinking agent is crosslinked with the cellulosic substrate, the linkages between the reactive groups on the crosslinking agent and the hydroxy groups on the cellulosic fiber are stable to most conventional washings, including the ten home launderings specified in 16 C.F.R. 1630 and 1631 for carpets which have been treated with a flame retardant.

The treated fiber can be present alone or as blends of cotton and other commercially available fibers, including polyester. The fibers can be used to prepare suitable articles of manufacture, including carpets, raised surface apparel, other garments, upholstery, and other articles which have acceptable fire resistance based on required tests for that particular use. In a preferred embodiment, the fiber is cotton and the article of manufacture is a cotton-based carpet or raised surface apparel. The treated cotton carpets can have an area density between about 20 oz/yd$^2$ and 120 oz/yd$^2$, preferably between about 30 oz/yd$^2$ and 80 oz/yd$^2$.

The compositions can optionally include additional components, such as other fire retardants, dyes, wrinkle resist agents, foaming agents, buffers, pH stabilizers, fixing agents, stain repellants such as fluorocarbons, stain blocking agents, soil repellants, wetting agents, softeners, water repellants, stain release agents, optical brighteners, emulsifiers, and surfactants.

In those embodiments in which phosphorus based compounds are used, the resulting cellulosic substrate can be fire retardant enough for use in end uses requiring flame-retardant finishes. Examples of such end uses include protective clothing (e.g., foundry workers apparel and fire fighters uniforms), children's sleepwear, furnishing/upholstery, bedding, carpets, curtains/drapes, and tents.

DETAILED DESCRIPTION OF THE INVENTION

Compositions and methods for providing cellulosic substrates with reduced flammability, and articles of manufacture prepared from the resulting fire-resistant cellulosic substrates, are disclosed.

The compositions include one or more crosslinking agents, and optionally include one or more phosphorus-based compounds. The methods involve applying to a cellulosic fiber a composition including crosslinking agents, and optionally including one or more phosphorus-based compounds, and allowing the compounds to react with the substrate for an effective amount of time. When the compounds are applied in an aqueous solution, the temperature can be raised to a temperature suitable for driving off the water, and the reaction allowed to occur in the substantial absence of aqueous solvent.

Depending on the density of the cellulosic substrate, the substrate alone, such as a cotton carpet or raised surface apparel, can be nearly fire resistant enough to meet the U.S. requirements for flammability. A small increase in fire resistance can be sufficient to meet the U.S. guidelines. Accordingly, the use of conventional fire retardants such as organophosphorus compounds, halogenated aromatics, and metal carbonates, which impart fire resistance but which each have inherent problems associated with their use, can be avoided. Alternatively, when used, for example, in protective clothing, phosphorus based compounds can be used, to impart a higher level of fire retardancy to the resulting cellulosic substrate.

Definitions

The following definitions are used herein:

The term "pill test" as used herein is a test used to determine whether a carpet is sufficiently fire resistant for use in the home. It calls for igniting a methenamine pill, which is placed in the center of a nine-inch by nine-inch carpet specimen. If the flame spreads to within one inch of a metal template containing an eight-inch diameter hole, which is placed on top of the carpet specimen prior to igniting the pill, the specimen fails. If the flame does not spread to within one inch of the metal template, then the specimen passes. For a residential carpet, as described above, to be saleable, at least seven out of eight specimens must pass the test. Furthermore, if the carpet has been treated with a flame-retardant (with the exception of alumina trihydrate added to the back coating), then the carpet must be washed ten times as described in AATCC 124-1967 prior to testing.

The term "45 degree angle test" as used herein refers to the flammability test for wearing apparel outlined in the Code of Federal Regulations Title 16, Part 1610. This test method determines the flammability of fabrics with raised surface fibers such as fleece. It calls for placing the specimen to be tested at a 45 degree angle and igniting it by exposing the surface to an open flame for one second. The flame must be one inch from the tip of the flame to the gas nozzle. The rate and intensity of the spread of the flame will categorize the flammability of the fabric.

The term "acceptable hand" as used herein refers to the feel of the resulting substrate after it has been treated with the fire retardant composition.

The term "cellulosic substrate" as used herein refers to substrates that include cellulosic fibers, such as cotton, jute, flax, hemp, ramie, lyocell, regenerated unsubstituted wood celluloses such as rayon, blends thereof, and blends with other fibrous materials in which at least about 25 percent, preferably at least about 40 percent of the fibers are cellulosic materials. The term "fiber" relates to fibers present in a substrate such as a carpet, raised surface apparel, upholstery, woven, knit, and nonwoven fabrics, and the like.

The term "flame retardant" as used herein refers to the chemical applied to the cellulosic substrate. The term "flame resistant" refers to the treated cellulosic substrate. The terms "flame resistant" and "reduced flammability" as applied to substrates are not intended to imply that the materials are fireproof, or that they will not burn.

The term "effective fire retardant amount"refers to an effective amount such that the treated substrate passes the required flammability test for that particular substrate.

The term "degree of substitution" refers to the number of hydroxy groups in the cellulosic substrate which are esterified, on average, per glucose moiety. For example, fire resistance can be obtained by esterifying a relatively low number of hydroxy groups on average on the cellulosic substrate. In one embodiment, the degree of substitution on the cellulosic substrate is between about 0.003 to 0.5. In another embodiment, the degree of substitution on the cellulosic substrate is between about 0.005 to 0.025.

The term "catalyst" is typically understood to mean a compound that facilitates a chemical reaction but which is regenerated, allowing further chemical reactions to take place. As used herein, the term "catalyst" also includes compounds which facilitate the coupling of carboxylic acid groups to hydroxy groups on a cellulosic substrate, even if the catalyst also eventually reacts with the substrate in some manner.

1. The Fire Retardant Composition

The fire-retardant composition includes a crosslinking agent, as well as various other optional components, along with a suitable solvent. The crosslinking agent is covalently linked to the cellulosic material.

A. Crosslinking Agents

As used herein, crosslinking agents are defined as any compound with two or more reactive groups which are capable of reacting with the hydroxy groups on cellulosic materials, or reacting with tosylate, mesylate, triflate or other leaving groups prepared from the hydroxy groups on cellulosic materials.

Reactive functional groups which participate in nucleophilic substitution reactions are typically nucleophiles, i.e., amine, hydroxy, and thiol groups, or leaving groups, i.e., chlorides, tosylates, mesylates, and the like. Using nucleophilic substitution chemistry, one typically cannot directly link two nucleophiles or two leaving groups. However, it is possible to link nucleophilic groups on two molecules by reacting them with a single molecule which has two leaving groups, or a functional group capable of reacting with both nucleophiles. This type of molecule is an example of a crosslinking agent. Crosslinking agents are well known to those of skill in the art.

Crosslinking agents can be used to covalently crosslink the hydroxy groups on the cellulosic material. Preferably, a sufficient quantity of crosslinking agents is present to covalently crosslink at least a sufficient amount of hydroxy groups on the cellulosic material to render it fire resistant enough for the intended use. For cotton carpets, a sufficient amount of crosslinking is typically between 0.12 and 2.0 percent of the hydroxy groups on the cotton.

Some crosslinking agents include one functional group which is capable of reacting with two or more nucleophilic groups under appropriate conditions. Examples of these include ureas, carbonates, orthocarbonates, chloroformates, urethanes, phosgene, diphosgene, triphosgene, thiophosgene, and the like, where the compound has two or more of these functional groups. Of these, ureas and other water-soluble crosslinking agents are preferred due to their relative ease of use and the avoidance of using organic solvents.

Preferred crosslinking agents are water-soluble, and react with the cellulosic substrate under relatively mild conditions (i.e., temperatures less than about 200° C. (although with certain substrates, such as fleece, temperatures higher than 200° C. are acceptable), pH between about 2 and 12, and do not contain appreciable amounts of formaldehyde or other materials known to be toxic to humans or animals on exposure. Preferred water-soluble crosslinking agents include ureas such as dimethyloldihydroxyethylene urea, imidazoles, imidazolidinones, dialdehydes, and dichlorotriazines.

Dichlorotriazinyl compounds are well known to those of skill in the art, and have been used for years as dyes for cellulosic substrates. Many of these compounds include carboxylic acid or sulfonic acid groups so that the compound is relatively water soluble at a certain pH range. An example of a suitable dichlorotriazinyl compounds is N,N'-bis (dichloro-s-triazinyl)-4,4'-diaminostilbene-2,2'-disodiosulphonate (T-DAS), which is well known to bond to cotton and also to amino, thiol and hydroxyl groups (see, for example, Lewis and Lao, "The use of a crosslinking agent to achieve covalent fixation of hydroxyethylsulphone dyes on cotton", AATCC 1998 International Conference and Exhibition, Philadelphia Marriott, Philadelphia, Pa., pages 375–383, (Sep. 22–25, 1998), the contents of which are hereby incorporated by reference).

Dialdehydes are also well known to those of skill in the art, and have been used for years to crosslink various compounds to proteins and peptides. Examples include $C_{2-6}$ dialdehydes, such as oxalaldehyde (Glyoxal), succindialdehyde and glutaraldehyde. They are typically sold as aqueous solutions, which are at least partially hydrated. Hydroxy groups are known to react with these compounds to form acetals and hemi-acetals. Amides, ureas and urethanes also react with dialdehydes to form various condensation products. Amines typically react with dialdehydes to form Schiff bases, which, if relatively unhindered, further react to form more complicated, uncharacterized products. The reaction with amide groups described above tends to proceed faster in alkaline media than in acidic media.

Imidazolidinones are commonly used in the textile industry. One example is dimethyloldihydroxy ethylene urea (DMDHEU). DMDHEU is commercially prepared from glyoxal, urea and formaldehyde, and often contains residual formaldehyde. The presence of residual formaldehyde is not advantageous when contact of the treated cellulosic materials with animals or humans is anticipated.

There are several commercially available imidazole derivatives commonly used as crosslinking agents in the textile industry. These include the Fixapret™ family of crosslinking agents sold by BASF, including Fixapret NF™, Which is commonly used with a catalyst system that include s a proprieta ry mixture of inorganic salts (Catalyst NB-202 from BASF). Examples of suitable water-soluble crosslinking agents include Fixapret® NF (BASF) and Freerez® NFR (Freedom Textile Chemicals, Co., Charlotte, N.C.).

B. Phosphorus-Based Compounds

The crosslinking agents which crosslink the cellulosic substrate can also crosslink the substrate with phosphorus-based compounds. As used herein, "phosphorus-based compounds" are compounds which include a phosphorus atom and which are capable of being covalently linked to a crosslinking agent and/or a cellulosic substrate. Numerous phosphorus-based compounds are known for their fire retardant properties. Any phosphorus-based compound which is capable of being crosslinked with a cellulosic substrate via a crosslinkin agent as defined herein can be used.

Preferably, the phosphorus-based compounds include one or more reactive groups which can react with the crosslinking agent. Examples of suitable groups include halogen, hydroxy, carboxylic acid, aldehyde and amide groups. Suitable phosphorus-based acids include phosphorus acid, hypophosphorus acid, and polyphosphoric acid, and also include alkali metal mono and dihydrogen phosphates and hypophosphites. Examples of other suitable phosphorus-based compounds include (di) phosphonium halide, dialkyl 1-amino-1-deoxyglucityl phosphonates, phosphorus amides, amino polyhydroxyalkyl phosphonic acid, phosphonitrile chloride, phosphorimidic chloride, tris(haloalkyl) phosphates, haloalkyl phosphates, dihydroxyalkyl phosphite, dialkylphosphonoalkane amide, bis(haloalkyl) haloalkyl phosphonate, (mercapto)phosphonitrilate, N-hydroxyalkyl phosphonic esters, bis-(hydroxyalkyl)-phosphinic acid, tetrakis (α-hydroxyalkyl) phosphonium halide, aryl haloalkyl phosphonate, hydroxyalkyl phosphonium salts, tris(polyhaloaryl) phosphate, halogenated phosphorthioates, phosphorus polyamides, phosphonitrilic halides, bis-(hydroxypolyalkoxyalkyl aminoethyl) phosphonates, where polyalkoxy is haloalkyl substituted, amino epoxy phosphonates and n-substituted derivative including polyphosphonates, N-hydroxymethyl-3-phosphonopropionamide, haloakyl or hydroxyalkyl-allyl-phosphonium halide, haloalkylphosphine oxide haloalkylphosphinic acids, tetrahydroxydiphosphorinane dioxide, tris(2-chloroethyl phosphate), tris(1-chloro-2-propyl) phosphate, tris (1,3-dichloro-2-propyl) phosphate, 2-bromoethyl-2-chloroethyl 3-bromopentyl phosphate, tetrakis (2-choroethyl)ethylene diphosphate, bis(2-chloroethyl) 2-chloroethyl phosphonate, oligomeric phosphonate-phosphate, oligomeric chlorethyl ethylene phosphate tris(3-hydroxypropyl) phosphine oxide, isobutylbis(3-hydroxypropyl) phosphine oxide, and bis(2-chloroethyl) vinyl phosphonate.

In a preferred embodiment, the phosphorus based compound is fixed onto the cellulosic substrate by reaction with maleic acid or another dicarboxylic or polycarboxylic acid and sodium phosphate, sodium hypophosphite.

As used herein, the term "alkyl" refers to monovalent straight, branched or cyclic alkyl groups preferably having from 1 to 20 carbon atoms, more preferably 1 to 10 carbon atoms ("lower alkyl") and most preferably 1 to 6 carbon atoms. This term is exemplified by groups such as methyl, ethyl, n-propyl, iso-propyl, n-butyl, iso-butyl, n-hexyl, and the like In those cases where the minimum number of carbons are greater than one, e.g., alkenyl (minimum of two carbons) and cycloalkyl, (minimum of three carbons), it is to be understood that "lower" means at least the minimum number of carbons.

As used herein, the term "aryl" refers to an unsaturated aromatic carbocyclic group of from 6 to 14 carbon atoms having a single ring (e.g., phenyl) or multiple condensed (fused) rings (e.g., naphthyl or anthryl). Preferred aryls include phenyl, naphthyl and the like. Unless otherwise constrained by the definition for the aryl substituent, such aryl groups can optionally be substituted with from 1 to 5 substituents and preferably 1 to 3 substituents selected from the group consisting of hydroxy, acyl, alkyl, alkoxy, alkenyl, alkynyl, substituted alkyl, substituted alkoxy, substituted alkenyl, substituted alkynyl, amino, substituted amino, aminoacyl, acyloxy, acylamino, alkaryl, aryl, aryloxy, azido, carboxyl, carboxylalkyl, cyano, halo, nitro, heteroaryl, heteroaryloxy, heterocyclic, heterocyclooxy, aminoacyloxy, oxyacylamino, thioalkoxy, substituted thioalkoxy, thioaryloxy, thioheteroaryloxy, and trihalomethyl. Preferred substituents include alkyl, alkoxy, halo, cyano, nitro, and trihalomethyl.

As used herein, the terms "halo" or "halogen" refer to fluoro, chloro, bromo and iodo and preferably is either bromo or chloro. The terms haloalkyl and haloaryl refer to alkyl and aryl groups substituted with between 1 and 5, preferably between 1 and 3 halogen groups.

The phosphorus-based compounds are preferably linked to the crosslinking agent, which is in turn crosslinked with the cellulosic substrate. Means for linking the phosphorus-based compounds and crosslinking agents described herein are well known to those of skill in the art.

In one embodiment, the phosphorus-based compounds are coupled via a crosslinking agent to a cellulosic substrate by forming phosphate ester linkages with the phosphoric acid groups on the phosphorus-based compounds and a first reactive group on the crosslinking agent, and a second reactive group on the crosslinking agent is then reacted with the cellulosic substrate.

In those embodiments in which phosphorus based compounds are used, the resulting cellulosic substrate can be fire retardant enough for use in end uses requiring flame-retardant finishes. Examples of such end uses include protective clothing (e.g., foundry workers apparel and fire fighters uniforms), children's sleepwear, funishing/upholstery, bedding, carpets, curtains/drapes, and tents.

For all of these fabric end uses, the chemicals can be applied, for example, by padding at 50–150 percent wet pickup, preferably between 70 and 100 percent wet pickup. However, other application techniques can also be used.

C. Suitable Solvents

Preferably, the crosslinking agents, along with any phosphorus-based compounds, are present in an aqueous solution, suspension or dispersion. However, other volatile solvents which are inert to the coupling chemistry and in which these materials are soluble or uniformly dispersible can be used.

D. Optional Components

Additional components can optionally be added to the fire-retardant composition. These include, but are not limited to, other fire retardants, dyes, wrinkle resist agents, foaming agents, buffers, pH stabilizers, fixing agents, stain repellants such as fluorocarbons, stain blocking agents, soil repellants, wetting agents, softeners, water repellants, stain release agents, optical brighteners, emulsifiers, and surfactants.

In one embodiment, the cellulosic substrate is a carpet. When other fire retardants are used in carpets, they can be present in the carpet fiber or the backing material. If a fire retardant is present in the backing layer, the fire retardant is preferably a material that activates at a temperature lower than alumina trihydrate. Preferably, no formaldehyde or other volatile organic compounds are released from the backing layer. Further, the fire retardants are preferably compatible with any latex formulation used in the carpet backing.

Suitable additional fire retardants include, but are not limited to, metal oxides, metal carbonates, halocarbons, phosphorus esters, phosphorus amines, phosphate salts, other phosphorus containing compounds, aluminum trihydrate, and nitrogen-containing compounds.

II. Cellulosic Substrates

Any cellulosic substrate which includes hydroxy groups can be treated with the above-compositions. Cotton is a preferred cellulosic fiber. Other cellulosic fibers include flax, jute, hemp, lyocell, ramie and regenerated unsubstituted wood celluloses such as rayon. The material can be a blend of fibers, such as a blend of cotton and a polyolefin such as polypropylene, a polyester or polytrimethyl terephthalate (PTT). The fiber composition is preferably at least 25, and, more preferably, at least 40 percent by weight cotton.

Any area density of carpet, raised surface apparel, or other woven, knit or nonwoven fabrics, can be constructed and used which is practical from a manufacturing standpoint. For carpet, an area density between 20 and 120 oz/yd$^2$, preferably between 30 and 80 oz/yd$^2$, is suitable.

III. Methods of Treating the Cellulosic Substrate

Methods for covalently linking a hydroxy group such as those on a cellulosic substrate and a reactive groups present on a crosslinking agent are well known to those of skill in the art. Preferably, the crosslinking agents do not contain formaldehyde or other toxic substances. Preferred methods are those which can be performed in aqueous solvents.

When the composition is applied to the cellulosic substrate by spray, foam or other low wet pickup methods commonly used for treating carpets with fluorochemicals, the percent by weight of the fire retardant solution which is applied to the cellulosic substrate is typically between about 5 and 100 percent by weight, preferably between about 10 and 50 percent by weight, and more preferably, between about 15 and 30 percent by weight of the fiber to be treated. The use of these methods and types of solutions helps to avoid adding excess water which will have to removed during drying.

The above ranges vary depending on the mode of application and the cellulosic substrate to be treated. For example, for raised surface apparel, larger amounts of the fire retardant solution may be required to achieve adequate fire resistance. The same general principal, of adjusting the solution concentration based on the total wet add-on, applies to other substrates as well, such as fiber fill, upholstery, children's sleepwear, bedding, batting, protecting clothing and drapes.

After the composition is applied and excess water is removed, the material is heated at a sufficient temperature and for a sufficient time to drive off the solvent and/or react the crosslinking agent with the groups on the cellulosic substrate, and optionally with the phosphorus-based compound.

The composition can also be applied by other application techniques, including by exhaust application. In an exhaust application the liquor ratio may vary over a broad range of about 2 to 1 up to about 50 to 1. More preferably about 3 to 1 to about 20 to 1, meaning about 20 pounds of treating solution per pound of cellulosic containing substrate. In one preferred embodiment the liquor ratio is about 10 to 1 and the concentration of the crosslinking agent is adjusted accordingly down to a concentration ranging from 0.001 percent to about 5.0 percent and preferably from about 0.01 to 1.0 percent on the weight of the treating liquor which is equivalent to 0.1 percent to 10.0 percent on the weight of the cellulosic substrate. Wet crosslinking agents, which can also be applied by exhaust techniques from the same bath, can be applied with phosphorus-based compounds to provide covalent linkages which result in treatments which are durable to various cleaning techniques. One such wet crosslinking agent is known as T-DAS, a dichlorotriazine crosslinking agent.

As with the spray and foam application described above, the crosslinking reaction can occur in the dry state after the excess water has been removed or in the wet state, before the excess water is removed.

The material can then optionally be rinsed to remove residual, unreacted chemicals, and then dried. However, since the crosslinking agents used typically do not provide the carpet with odor or toxicity, subsequent rinsing may not be desired. Further, any unreacted functional groups on the crosslinking agents may be used to attach other types of molecules, for example, via the formation of ester or amide linkages. Examples of such molecules include fluoroalkyl compounds commonly used to impart stain-resist properties to carpets and other textile goods.

For protective clothing (e.g., foundry workers apparel and fire fighters uniforms), children's sleepwear, furnishing/upholstery, bedding, carpets, curtains/drapes, and tents there are a variety of application techniques which can be used to apply the fire retardant solutions. These include immersion, dipping, dripping, cascading, liquor circulation throughout the substrate, padding, kiss rolls, and doctor blades. These techniques may be used alone or in conjunction with vacuum, squeeze rolls, centrifuge, air knives, gravity drainage or other techniques. The application can be done via a continuous or batch method.

The application(s) of the crosslinking agent(s) may be done to the fiber, yarn, fabric or carpet, either before, after, or in conjunction with other manufacturing or processing steps, such as dyeing, winding, finishing, cabling, heat setting, tufting or weaving.

For raised surface apparel, or any other apparel that may benefit from a reduction in flammability, the application may be done by any of the above mentioned techniques in fiber, yarn, fabric or garment form. Spraying, foaming, dipping or the "Metered Addition Process" are particularly suitable for garment application. The total amount of solution added to the substrate and the required concentration of crosslinking agent(s) in the solution will be dependent on many factors including the flammability test method, the weight and construction of the substrate, and blend levels of the many possible fibers in a blend.

The concentration of crosslinking agent(s) required to be effective, based on both the weight of the solution and on the weight of the substrate, will be dependent on the factors mentioned above for all substrates including raised surface apparel, carpets, upholstery, and any other substrate where it is desirable to reduce the flammability. Any of the application techniques which are mentioned above, or which are used to apply other chemical treatments to fibrous substrates, are considered suitable to be used herein for any cellulosic substrate where it is desired to reduce the flammability.

Where liquor ratios of the treating bath or solution are greater than 1:1 (i.e. greater than one pound of treating solution per pound of substrate), pre-treatment techniques, such as cationic pre-treatments can be used to encourage the treatment chemicals, for example, the crosslinking agents and/or phosphorus based compounds, to exhaust or move out of the solution and onto the cellulosic substrate.

Although the temperature required to effectively form the linkages would be expected to vary somewhat depending on the nature of the substrate to be treated and the crosslinking agent(s), a typical range of temperatures is between about 20 and 240° C., more preferably between 40 and 200° C. The temperature is preferably less than would otherwise be required to scorch or melt thermoplastic components of the substrate. Excessive heating can cause yellowing of the substrate fibers, so care should be taken to control the reaction temperatures. Crosslinking agents which will react with the cellulosic material, and, optionally, the phosphorus-based compound, in the wet state can be used to achieve fixation or reaction in the dyeing equipment used to dye cellulosic substrates.

Suitable reaction times are typically between approximately one minute and five hours. However, the reaction times relate in part to the pH of the fire retardant solution. At a pH less than 11 for hydroxy, thiol and amine groups, or greater than 4 for carboxylic acids, cure times are generally longer. However, there appears to be less of a change in the dye shade of dyed goods when a pH greater than 4 is used.

Carpets typically have a polypropylene backing layer, which tends to melt at temperatures above 300° F. For this reason, it is preferable that this temperature not be exceeded when this type of carpet is treated. However, raised surface apparel, upholstery, drapes, bedding, protective clothing, batting, fabrics, fiber fill, and carpets with non-thermoplastic backings may not have this type of temperature limitation. When these types of substrates are treated, the reaction temperature may be elevated as required, consistent with the scorching and/or yellowing temperature of these materials. One of skill in the art can readily determine an appropriate set of temperatures for a particular substrate to be treated.

Those of skill in the art can readily determine an appropriate set of reaction conditions (amount of fire retardant solution to add and suitable temperatures and reaction times) to couple the crosslinking agent(s) to the cellulosic substrate.

IV. Methods of Evaluating the Fire Retardant Cellulosic Compositions

The suitability of the fire retardant composition for an intended use will depend on the ability of the treated cellulosic substrate to pass various standard flammability tests. The currently accepted test for carpets is the pill test. The currently accepted test for raised surface apparel is the 45 degree angle test. Other substrates or end uses such as protective clothing or children's sleepwear may require a vertical flammability test or other flammability tests.

The testing protocol for these tests is well known to those of skill in the art. Using these tests, with a suitably prepared reduced flammability cellulosic fiber composition, one can readily determine the efficacy of the fire retardant composition for its intended use.

V. Articles of Manufacture Prepared from the Composition

The treated fiber compositions can be used for several purposes, including articles of clothing such as protective clothing (e.g., foundry workers apparel and fire fighters uniforms), raised surface apparel and children's sleepwear, furnishing/upholstery, bedding, carpets, curtains/drapes, and tents. Cotton carpets and raised surface apparel are preferred articles of manufacture when the crosslinking agent alone, in the absence of a phosphorus based compound, is used. When used in carpets, the fiber preferably has an area density of between 20 oz/yd$^2$ and 120 oz/yd$^2$, more preferably between 30 oz/yd$^2$ and 80 oz/yd$^2$.

The invention will be better understood with reference to the following non-limiting example:

EXAMPLE 1

Evaluation of Crosslinkers for Fixing (Bonding) a Phosphorus-Based Flame Retardant (FR) at a Low Curing Temperature Summary Two modified ethyleneurea-type (EU) resins yielded a reasonable fixation of the phosphorus-based FR agent onto cotton carpets. The percent fixation after ten (10) home launderings was in the same range as the original reactive, phosphorus-based FR agent.

Introduction

A phosphorus-containing finish (FR) can provide reduced flammability of cotton carpets. In order to make this finish durable to the ten launderings required by federal regulations, a crosslinker was used to attach this FR finish to the cotton.

Objective

Curing time was evaluated with one crosslinking resin. Several resins were applied under the same curing conditions to compare the effectiveness of each as a crosslinker for the FR.

Experimental Approach

TABLE I displays the formulations which were sprayed onto the 90/10 cotton/Foss low-melt polyester carpet CD-98-026 (cut pile, ⅛ inch gauge, 9 stitches per inch (SPI), 21/32 inch pile height) at 15% target add-on. Actual application levels are given in TABLE II. All specimens were dried at 220F. (104C.) for fifteen minutes, while the remaining samples (2–4 and 6–8) were cured for 20 minutes at the same temperature. Pill tests were performed on two 5 inch×5 inch pieces before laundering (HLTD), after 1 HLTD and after 10 HLTD. Phosphorus (P) analysis was done by ICP-OES at Galbraith Laboratories.

TABLE I

Formulations
(Concentrations are given as % on weight of liquor)

| # | FR | Resin Type | % Resin | Catalyst | % Catalyst | Fluoro-chemical | Water |
|---|---|---|---|---|---|---|---|
| 5/1 | 10 | PCA | 10 | $NaH_2PO_2$ | 5 | 5 | 70 |
| 5/2 | 10 | PCA | 10 | $NaH_2PO_2$ | 5 | 5 | 70 |
| 5/3 | 10 | EU1 | 10 | $MgCl_2$(1) | 2 | 5 | 73 |
| 5/4 | 10 | EU2 | 10 | $MgCl_2$(2) | 5 | 5 | 70 |
| 5/5 | 5 | PCA | 5 | $NaH_2PO_2$ | 5 | 5 | 80 |
| 5/6 | 5 | PCA | 5 | $NaH_2PO_2$ | 5 | 5 | 80 |
| 5/7[1] | 5 | 0 | 0 | $MgCl_2$(3) | 5 | 5 | 85 |
| 5/8 | 0 | 0 | 0 | 0 | 0 | 0 | 100 |

[1]Sample 7 contained the FR (control).

TABLE II

Target and Actual Carpet Weights and Application Levels (% add-on)

| Carpet Sample | Initial Dry wt. (g) | Target wt. (after spray) (g) | Actual wt. (after spray) (g) | Actual % add-on | Target conc. % owc FR/resin | Actual conc. % owc FR/resin |
|---|---|---|---|---|---|---|
| 5/1 | 211.57 | 243.31 | 244.47 | 15.6 | 1.50/1.50 | 1.56/1.56 |
| 5/2 | 212.31 | 244.16 | 244.83 | 15.3 | 1.50/1.50 | 1.53/1.53 |
| 5/3 | 206.47 | 237.44 | 243.34 | 17.9 | 1.50/1.50 | 1.79/1.79 |
| 5/4 | 207.64 | 238.79 | 247.62 | 19.3 | 1.50/1.50 | 1.93/1.93 |
| 5/5 | 200.21 | 230.24 | 232.36 | 16.1 | 0.75/.075 | 0.81/0.81 |
| 5/6 | 205.19 | 235.97 | 236.41 | 15.2 | 0.75/0.75 | 0.76/0.76 |
| 5/7 | 207.44 | 238.56 | 242.34 | 16.8 | 0.75/0.00 | 0.84/0.00 |
| 5/8 | 184.63 | 212.32 | 211.69 | 14.7 | 0.00/0.00 | 0.00/0.00 |

*owc = On Weight of Carpet

Results and Discussion

As the results in TABLE III indicate, the samples that were cured for a longer time and were treated with higher concentrations of FR and crosslinker had poorer hand than the control samples. Curing for a shorter time can produce acceptable hand. At a FR/crosslinker concentration of 1.50/1.50 owc, all samples passed the pill test, even after 10 home launderings.

TABLE III

Appearance and Flammability Test Results

| Sample | Odor | Hand | Yellowing | Before wash[1] Pill Test | After 1 HL[1] Pill Test | After 10 HL[1] Pill Test |
|---|---|---|---|---|---|---|
| 5/1 | Slight | Soft | No | Pass | Pass | Pass |
| 5/2 | No | Fair | No | Pass | Pass | Pass |
| 5/3 | Very Slight | Fair | No | Pass | Pass | Pass |
| 5/4 | No | Fair | No | Pass | Pass | Pass |
| 5/5 | No | Soft | No | Pass | Fail | Pass |
| 5/6 | No | Fair | No | Pass | IP/1F | 1P/IF |
| 5/7 | No | Soft | No | Pass | Pass | Pass |
| 5/8 | No | Soft | No | Fail | Fail | Pass |

TABLE III-continued

Appearance and Flammability Test Results

| Sample | Odor | Hand | Yellowing | Before wash[1] Pill Test | After 1 HL[1] Pill Test | After 10 HL[1] Pill Test |
|---|---|---|---|---|---|---|

[1]Pass = both specimens passed. Failed = both specimens failed. 1P/1F = 1 passed and 1 failed. HL = Home Launder.

Modified EU-type resins are preferred over PCA resins for crosslinking the FR.

TABLE IV

Phosphorus Analysis Results

| Sample | Avg. P (%) Before wash | Avg. P (%) After 1 HLTD | Avg. P (%) After 10 HL | Avg. % fixation after 10 HL |
|---|---|---|---|---|
| 5/1 | 0.50 | 0.04 | 0.02 | 4 |
| 5/2 | 0.64 | 0.09 | 0.05 | 8 |
| 5/3 | 0.28 | 0.10 | 0.11 | 39 |
| 5/4 | 0.48 | 0.22 | 0.13 | 27 |
| 5/5 | 0.28 | 0.12 | 0.01 | 4 |
| 5/6 | 0.71 | 0.02 | 0.02 | 3 |
| 5/7 | 0.16 | 0.10 | 0.05 | 31 |
| 5/8 | 33 ppm | 18 ppm | 20 ppm | 0 |

The FR agent, in conjunction with crosslinking chemistry is effective at reducing the flammability of cotton carpet.

Product Identification

| Generic Name | Product Name | Supplier |
|---|---|---|
| | $NaH_2PO_2$ | OxyChem |
| $MgCl_2$(1) | Freecat LF | Freedom Textile Chemical |
| $MgCl_2$(2) | NB-202 | BASF |
| $MgCl_2$(3) | Catalyst 531 | Sequa Chemicals |
| Flurochemical | Scotchgard FX-1367 | 3M |
| FR | Fyrol 51 | Akzo Nobel Chemical |
| FR (control) | Pyrovatex CP new | Ciba Specialty Chemicals |
| PCA resin | Belclene 60 | FMC |
| EU1 | Freerez NFR | Freedom Textile Chemical |
| EU2 | Fixapret NF | BASF |

I claim:

1. A method for preparing cellulosic substrates with reduced flammability comprising:

a) preparing a composition comprising one or more crosslinking agents selected from the group consisting of dimethyloldihydroxyethylene urea, imidazoles, and imidazolidinones;

b) applying an effective, fire retarding amount of the composition to a substrate to be treated which comprises a cellulosic fiber or a blend of a cellulosic fiber with another fiber; and c) linking reactive groups on the crosslinking agent(s) with a sufficient quantity of the hydroxy groups on the fiber to be treated such that the resulting treated fiber has an acceptable degree of fire resistance for the intended use.

2. The method of claim 1, wherein the crosslinking agent(s) is substituted with one or more functional groups selected from the group consisting of carbon-carbon double bonds, halides, perfluorinated groups, amines, phosphorus esters, monosaccharides, polysaccharides, imides, and amides.

3. The method of claim 1, wherein the degree of substitution on the cellulosic substrate is between about 0.003 to 0.5.

4. The method of claim 1, wherein the degree of substitution on the cellulosic substrate is between about 0.005 to 0.025.

5. The method of claim 1 wherein the fiber is a cotton fiber.

6. The method of claim 5, wherein the cotton is in the form of a cotton carpet.

7. The method of claim 5, wherein the cotton is present in raised surface apparel.

8. The method of claim 1, wherein the fiber is a blend of cotton and another fiber selected from the group consisting of polyesters, polyamides, polytrimethyl terephthalate (PTT), wool, acrylic, modacrylic, rayon, acetate, triacetate, polyolefins, and lyocell.

9. The method of claim 1, wherein the fire-retardant composition further comprises an additional fire retardant selected from the group consisting of metal oxides, metal carbonates, halocarbons, phosphorus esters, phosphorus salts, phosphorus amines, aluminum trihydrate, and nitrogen-containing compounds.

10. The method of claim 1, wherein the composition further comprises a component selected from the group consisting of other fire retardants, dyes, wrinkle resist agents, foaming agents, buffers, pH stabilizers, fixing agents, stain repellants stain blocking agents, soil repellants, wetting agents, softeners, water repellants, stain release agents, optical brighteners, emulsifiers, and surfactants.

11. The method of claim 1 wherein the fiber is selected from the group consisting of lyocell and rayon.

12. The method of claim 1, wherein the fire-retardant composition further comprises a phosphorus-based compound.

13. The method of claim 12, wherein the phosphorus-based compound is selected from the group consisting of vinyl phosphonate, bis(2-chloroethyl)vinyl phosphonate, tetrakis (2-chloroethyl)diphosphates, oligomeric phosphate-phosphonate, and bis(2-chloroethyl)2-chloroethylphosphonate.

14. A method for preparing cellulosic fibers with reduced flammability comprising;

a) selecting a suitable cellulosic substrate, b) pre-treating the substrate with a cationic pretreatment, c) optionally removing excess pretreatment, d) adding an effective, fire retarding amount of a composition comprising one or more crosslinking agents to the pre-treated substrate, the crosslinking agents selected from the group consisting of dimethyloldihydroxyethylene urea, imidazoles, and imidazolidinones, and e) optionally linking reactive groups on the crosslinking agent(s) with a sufficient quantity of the hydroxy groups on the fiber to be treated such that the resulting treated fiber has an acceptable degree of fire resistance for the intended use, wherein the ratio by weight of the solution to the substrate is greater than 1:1.

15. The method of claim 14 further comprising a dyeing step in conjunction with or prior to the pre-treatment step.

16. The method of claim 14, wherein the composition further comprises a phosphorus-based compound.

17. A method for preparing cellulosic substrates with reduced flammability comprising:

a) preparing a composition comprising one or more crosslinking agents and a phosphorus-based compound, the one or more crosslinking agents being selected from the group consisting of dimethyloldihydroxyethylene urea, imidazoles, and imidazolidinones;

b) applying an effective, fire retarding amount of the composition to a substrate to be treated which comprises a cellulosic fiber or a blend of a cellulosic fiber with another fiber; and c) linking reactive groups on the crosslinking agent(s) with a sufficient quantity of the hydroxy groups on the fiber to be treated and a sufficient amount of the phosphorus-based compound such that the resulting treated fiber has an acceptable degree of fire resistance for the intended use.

18. The method of claim 17, wherein the phosphorus-based compound is selected from the group consisting of vinyl phosphonate, bis(2-chloroethyl)vinyl phosphonate, tetrakis (2-chloroethyl)diphosphates, oligomeric phosphate-phosphonate, and bis(2-chloroethyl)2-chloroethylphosphonate.

19. The method of claim 1 wherein the one or more crosslinking agent is dimethyloldihydroxyethylene urea.

20. The method of claim 1 wherein the one or more crosslinking agents are imidazoles.

21. The method of claim 1 wherein the one or more crosslinking agents imidazolidinones.

* * * * *